US005435017A

United States Patent [19]

Pan

[11] Patent Number: 5,435,017

[45] Date of Patent: Jul. 25, 1995

[54] APPARATUS FOR AUTOMATICALLY BUT DELAYEDLY LIFTING A TOILET SEAT

[76] Inventor: Chien-Pang Pan, 19, Lane 891, Chien-Shou Rd., Taihsi, Taoyuan,

[21] Appl. No.: 168,040

[22] Filed: Dec. 15, 1993

[51] Int. Cl.[6] ..... A47K 13/10

[52] U.S. Cl. ..... 4/246.2; 4/241

[58] Field of Search ..... 4/246.1, 246.2, 237, 4/241

[56] References Cited

U.S. PATENT DOCUMENTS 5,138,724 8/1992 Chien et al. ..... 4/246.2

FOREIGN PATENT DOCUMENTS 96211 3/1976 China .

OTHER PUBLICATIONS

English Translation of the Abstract of Rep. of China Patent Applicaiton No. 75212373 (Rep. of China Publication No. 96211).

*Primary Examiner*—Charles E. Phillips
*Attorney, Agent, or Firm*—Ladas & Parry

[57] ABSTRACT

An apparatus for automatically but delayedly lifting a toilet seat has a positioning base, a lifting weight and an L-shaped lifting rod. The positioning base is adapted to be firmly secured onto a toilet and includes a short shaft laterally extending therefrom. The lifting weight is a hollow housing including a fore-portion, a mid-portion and a post-portion. The fore-portion is formed with a transverse shaft hole for the short shaft of the positioning base. The mid-portion is formed with a front chamber, and the post-portion is formed with an upper and a lower chamber for containing water or other fluid to create a fluid weight effect. The L-shaped lifting rod is attached at one end to the free end of the fore-portion of the lifting weight and the opposite free end thereof is adapted to inserted between the toilet seat and the toilet. Water can flow among the front, upper and lower chambers to change the lifting torque, so that the toilet seat can be automatically but delayedly lifted by its weight.

4 Claims, 6 Drawing Sheets

APPARATUS FOR AUTOMATICALLY BUT DELAYEDLY LIFTING A TOILET SEAT

BACKGROUND OF THE INVENTION

The present invention relates to an apparatus for automatically but delayedly lifting a toilet seat.

Due to laziness, a user of a toilet usually does not lift a toilet seat after the use of the toilet seat. Furthermore, when a male urinates into a toilet on which the toilet seat was not lifted, the toilet seat is very likely be polluted or fouled. To solve these problems, there are many apparatuses known in the art to provide an automatically lifted toilet seat.

Generally, the known apparatuses for automatically lifting a toilet seat can be classified into the following categories:

1. Spring type: an apparatus of this type mainly makes use of the resilience of springs to lift the toilet seat when a user gets off the toilet seat. However,the operation of an apparatus of this type is very likely to deteriorate with the deterioration of the resilience and other fatigue of the springs used therein.

2. Lifting weight type: an apparatus of this type mainly makes use of two lifting weights on pivot shafts in association with connecting rods and wires automatically lift the toilet seat. An apparatus of this type, however, has the following disadvantages:

1) The apparatus is difficult to assemble due to the use of the connecting rods and wires and the relatively large mass of the lifting weights necessary in order to lift the toilet seat weights should have relatively large mass because they are so close to the pivots; and 2) Since the toilet seat will be automatically lifted at any time, the apparatus inconveniences a user, because the user has to use his hand to press the toilet seat until she or he sits on the toilet seat.

3) Fluid lifting type: an apparatus of this type mainly provides three fluid chambers integratedly formed within a toilet seat so that fluid can flow to create a torque about a pivot shaft of the toilet seat to automatically delayedly lift the toilet seat. An apparatus of this type, however, has the following disadvantages:

1) Since the pivot shaft is at the upper part of the central portion of the rear end of the toilet, the fluid chambers for the torque are between the pivot shaft and a water tank where space is very limited, because the rear end of the toilet seat cannot extend outwardly from the tank too much and, in order to create sufficient torque for lifting the toilet seat with the resulting short lever arm the toilet seat of this type is uneconomic to manufacture;

2) When the toilet seat is lifting, the flowing of the fluid very likely causes the seat to oscillate left and right. Even if the toilet seat has lifting weights at both lateral sides, it still cannot attain sufficient balance to prevent oscillation when it is lifted and besides, the two lifting weights symmetrically on the lateral sides of the toilet seat make it uneconomic to manufacture; and 3) Since the rear end of the toilet seat of this type is very large, it is very possible that it cannot be installed on a toilet due to the location of the toilet or its water tank. Besides, the original toilet seat must be replaced, which is uneconomic.

SUMMARY OF THE INVENTION

Therefore, the primary object of the present invention is to provide an apparatus for automatically and delayingly lifting a toilet seat.

The apparatus comprises a positioning base, a lifting weight, and an L-shaped lifting rod.

The positioning base is provided with two elongated slots adapted to be passed through by respective bolts so as to be secured on a toilet, and includes a short shaft laterally from one sidewall of the positioning base.

The lifting weight is a hollow housing including a fore-portion, a mid-portion and a post-portion. The fore-portion is formed with a transverse through hole adapted to receive the short shaft so that the lifting weight pivotally secured on the laterally extending short shaft to freely swing about the short shaft. The mid-portion has a hollow and elongate front chamber. The post-portion has upper and a lower chambers. The front chamber is in direct fluid communication with the upper chamber. The lower chamber has two small apertures, i.e., the first and second small apertures, respectively in fluid communication with the upper chamber and the front chamber. As used herein, direct fluid communication means fluid communication substantially without restriction on the flow of the fluid and the small apertures mean with restriction on the flow of the fluid. The upper chamber is provided with an opening at its upper surface to allow water or some other fluid to be introduced into the lifting weight.

The L-shaped lifting rod is secured at the front end of the fore-portion of the lifting weight and is adapted to be inserted between a toilet seat and a toilet.

A rack having a plurality of through holes is provided at the upper surface of the lifting weight. A balance weight made of high density material is arranged and secured onto the rack of the lifting weight for adjusting the balance condition of the lifting weight when it is installed on a toilet.

When the lifting weight is filled with water, the water can flow among the front, upper and lower chambers. When the toilet seat is laid flat on the toilet, water will flow directly from the upper chamber into the front chamber, so that the toilet seat can stay down on the toilet. While the toilet seat stays down on the toilet, however, the water in the front chamber will gradually and slowly flow into the lower chamber to create a greater torque for lifting the toilet seat, so that the toilet seat can be automatically and delayedly lifted by the torque created by the weight of water transferred among the front, upper and lower chambers.

The further object of the present invention is to provide a toilet seat assembly adapted to be automatically and delayingly lifted. The toilet seat assembly comprises a positioning base and a toilet seat integratedly secured with a lifting weight like that described hereinabove, so that the toilet seat can be automatically and delaying lifted.

These and other objects, advantages and features of the present invention will be more fully understood and appreciated by reference to the drawing, wherein:

DETAILED DESCRIPTION OF THE INVENTION

Figure 1:
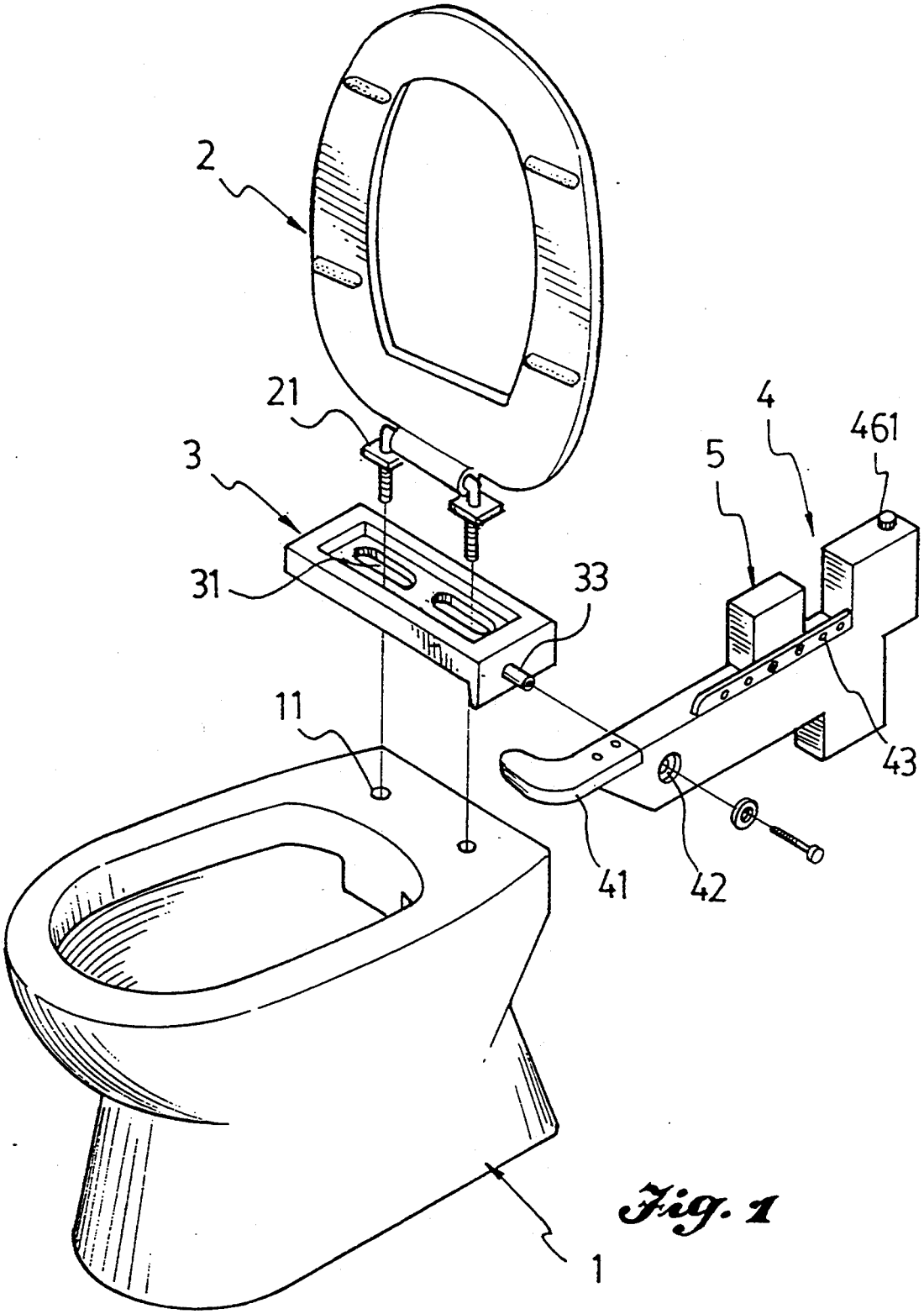
FIG. 1 is an exploded side/front/top perspective view showing an apparatus for automatically and delayingly lifting a toilet seat installed on a toilet.

Referring now to FIG. 1, an apparatus for automatically but delayedly lifting a toilet seat in accordance with the present invention mainly comprises a positioning base 3, a lifting weight 4, and a L-shaped lifting rod 41.

The positioning base 3 includes two elongate through slots 31 at the place corresponding to two installation through holes 11 of a conventional toilet 1. The positioning base 3 further includes a short shaft 33 transversely extending from one lateral side of the positioning base 3. Both lateral sides of the positioning base 3 extend out from the edges the toilet on which it is installed.

The lifting weight 4 is a hollow housing having a fore-portion, a mid-portion and a post portion. The fore-portion is formed with a transverse through shaft hole 42 and is securely connected with one end of the L-shaped lifting rod 41.

The opposite end of the L-shape of the lifting rod 41 extends into the space between the toilet 1 and the toilet seat 2.

Figure 2:
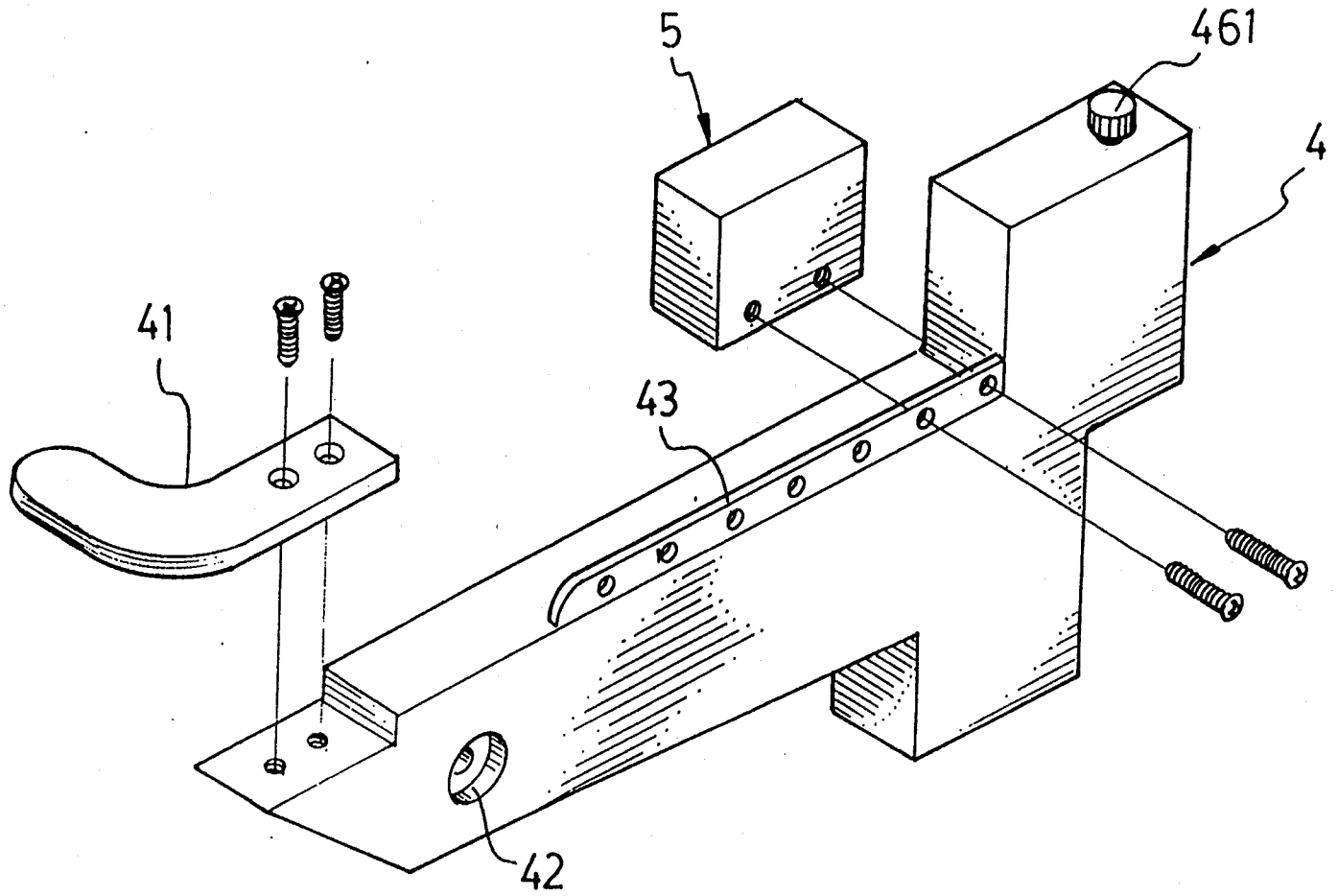
FIG. 2 is an exploded side/front/top perspective view of one preferred embodiment of a lifting weight portion of the apparatus for automatically and delaying lifting a toilet seat in accordance with the present invention.
Figure 4:
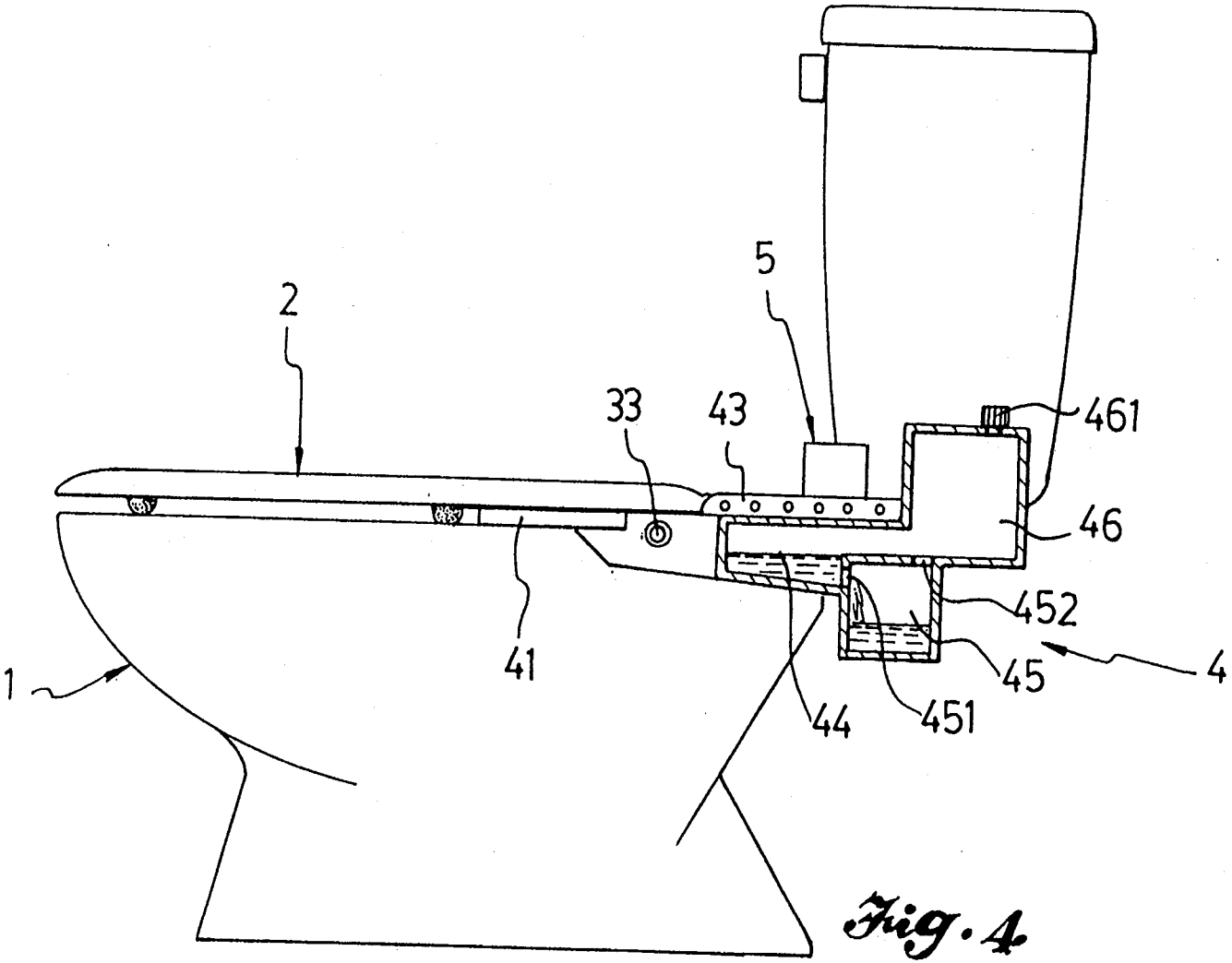
FIG. 4 is a partly cross-sectional side view showing the apparatus for automatically and delayingly lifting a toilet seat installed on a toilet, in the fluid condition when the toilet seat has just been laid down on the toilet.

As can be seen from FIGS. 1, 2, and 4, the mid-portion of the lifting weight 4 is formed with a front chamber 44. The front chamber 44 is in an elongate configuration, so that the overall length of the lifting weight is increased by its elongation. The post-portion is formed with an upper and a lower chamber 46 and 45. The front chamber 44 is in direct fluid communication with the upper chamber 46. The lower chamber 45 has a first small aperture 451 and a second small aperture 452 respectively in fluid communication with the front chamber 44 and the upper chamber 46. When the lifting weight 4 is in a horizontal position as shown in FIG. 4, the location of the upper chamber 46 is higher than the front chamber 44 and the lower chamber 45, and the location of the front chamber 44 is higher than the location of the lower chamber 45, so that water in the upper chamber 46 can directly flow into the front chamber 44 and then gradually and slowly flow into the lower chamber 45 through the first small aperture 451.

Referring to FIGS. 1, 2, 3 and 4, the lifting weight 4 further comprises a water supplying aperture 461 through which water can be introduced into the lifting weight 4 to create a fluid lifting weight effect. The water supplying aperture 461 has a cap to prevent the water from leaking out through the aperture 461.

Figure 3:
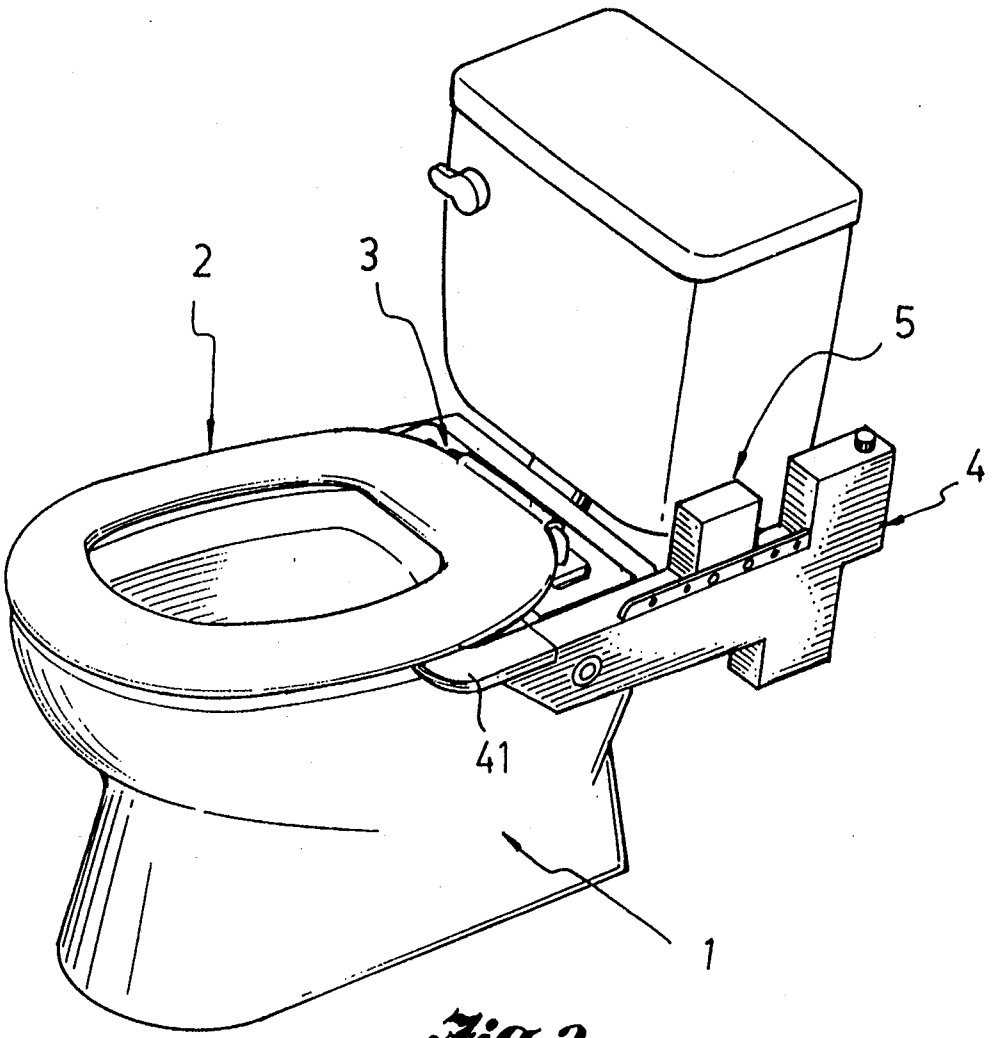
FIG. 3 is a side/front/top perspective view showing the apparatus for automatically and delayingly lifting toilet seat, in accordance the present invention, installed on a conventional toilet.

As can be seen from FIGS. 1 and 3, when the apparatus is assembled on the toilet 1, two blots 21 pass through the elongated through slots 31 of the positioning base 3 to firmly secure the positioning base 3 and the toilet seat 2 on the toilet 1. The transverse shaft hole 42 of the lifting weight 4 receives the short shaft 33 of the positioning base 3 and then the positioning base 3 and lifting weight 4 are pivotally secured by a screw passing through a washer. Since the lifting weight 4 is pivotally mounted on the laterally extending short shaft 33 to keep away from the location of the water tank, the lifting weight 4 can freely swing about the short shaft 33 without any obstruction by the water tank and the toilet. In the assembled condition, the free end of the L-shaped lifting rod 41 is located between the toilet seat 2 and the toilet 1.

Figure 5:
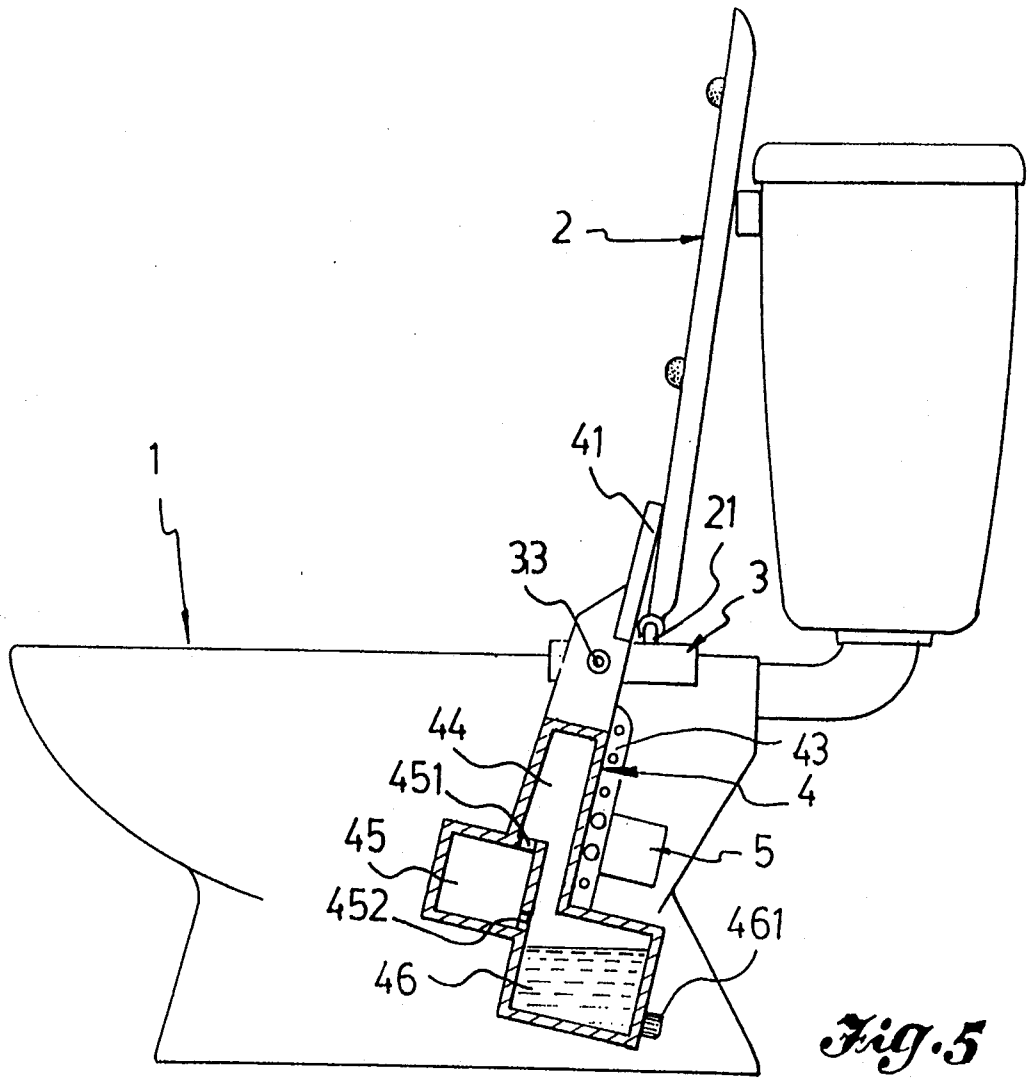
FIG. 5 is a partly cross-sectional side view showing the apparatus for automatically and delayingly lifting a toilet seat installed on a toilet, in the fluid condition well after the apparatus has lifted the toilet seat.

Referring to FIGS. 1, 3, and 5, when the toilet seat 2 is pressed by a user onto the toilet 1 to be in a horizontal position, fluid (e.g. water) contained within the upper chamber 46 will quickly and directly flow into the front chamber 44. Since the location of the front chamber 44 is closer to the pivot shaft 33 than the upper chamber 46, the torque created by water contained in the front chamber 44 is less than the torque created by the water contained in the upper chamber 46. Since the toilet seat 2 itself has weight and is located at the opposite side of the pivot shaft 33 to create a torque which is greater than or equal to the torque created by water contained in the front chamber 44, the toilet seat 2 stays in the horizontal position shown in FIG. 4 in contact with the toilet 1.

Figure 6:
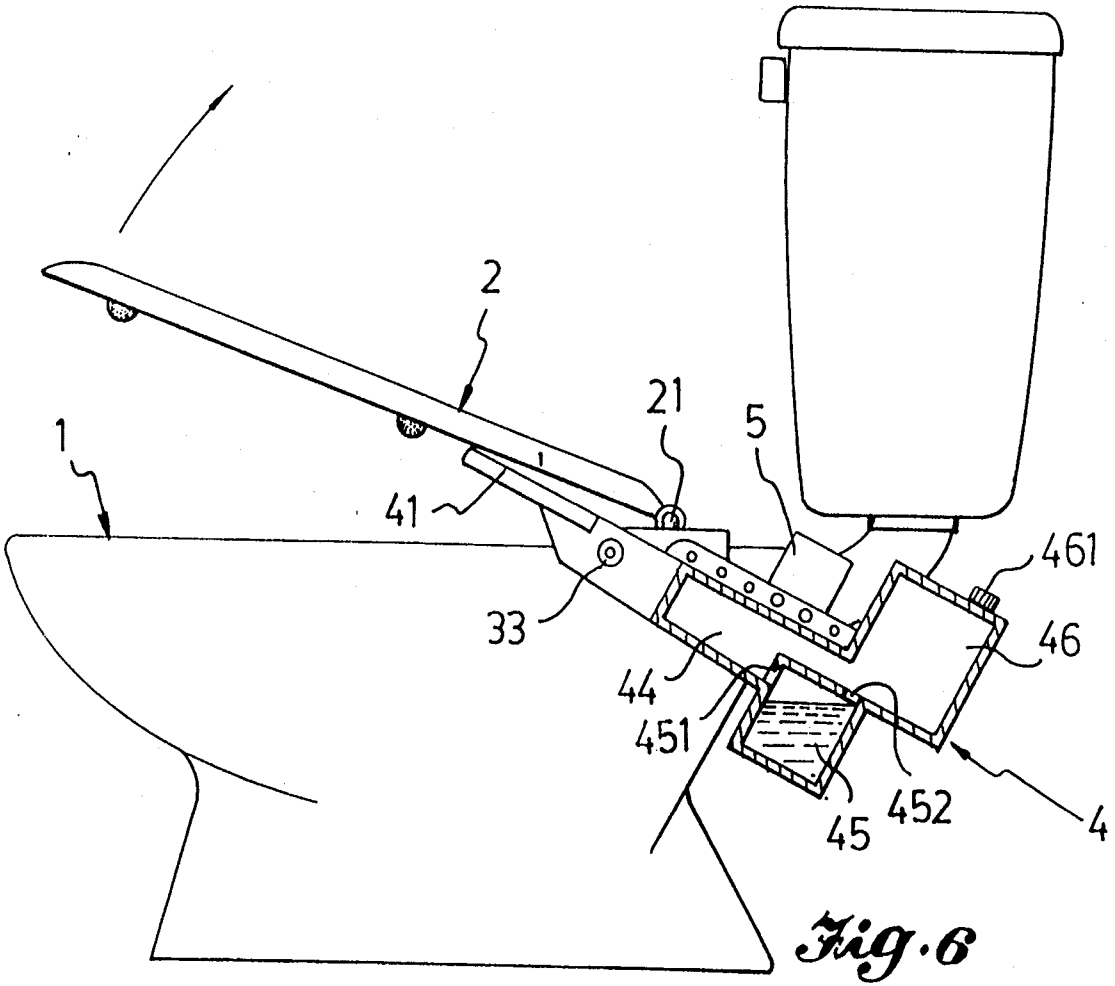
FIG. 6 is a partly cross-sectional side view showing the apparatus for automatically and delayingly lifting a toilet seat installed on a toilet, in the fluid condition while the apparatus is lifting the toilet seat.

Referring to FIGS. 4 and 6, when the toilet seat 2 has been put down on the toilet 1 and the water has moved to the front chamber 44, the water begins to gradually and slowly flow into the lower chamber 45 through the first small aperture 451. Since the lower chamber 45 is located farther from the pivot shaft 33 than the front chamber 44, when most of water has moved from the front chamber 44 to the lower chamber 45, the lifting weight 4 has a greater torque that is sufficient to overcome the torque created by the weight the toilet seat 2, and thus can lift the toilet seat 2 to be in a vertical position as shown in FIG. 5. However, since water in the front chamber 44 is only gradually and slowly transferred into the lower chamber 45 through the first small aperture 451, this delays the lifting operation of the toilet seat 2.

Referring to FIGS. 5 and 6, when the toilet seat 2 has been lifted to a vertical position, water contained in the lower chamber 45 flows from the lower chamber 45 into the upper chamber 46. Since the upper chamber 46 is farther from the pivot shaft 33 than the lower chamber 45, when most of water is transferred from the lower chamber 45 to the upper chamber 46 through the second small aperture 452, the lifting weight 4 has a still greater torque to maintain the toilet seat 2 in the vertical position and prevent the toilet seat 2 from accidentally falling down.

Referring to FIGS. 1 and 2, the lifting weight 4 further comprises a rack 43 and a balance weight 5. The rack 43 is an elongate bar longitudinally attached on the lifting weight 4 and includes a plurality through holes spaced apart from one another. The balance weight 5 is made of high density material and can be secured to the holes at different positions along the rack 43 by bolts, so as to adjust the balance condition of the apparatus in association with the particular toilet seat. As a result, the lifting weight 4 can be applied to existing toilet seats of various weights and dimensions.

The positioning base 3 lets the lifting weight 4 freely swing about the short shaft 33 without any obstruction by the water tank or the toilet 1. In addition, the elongate front chamber 44 increases the overall length of the lifting weight 4 so as to have a longer lever arm, whereby the lifting weight 4 can provide sufficient torque for lifting the toilet seat 2 without too much weight.

Besides, since the lifting weight 4 is pivotally mounted on the short shaft of the positioning base 3, the lifting weight 4 can smoothly and freely swing around the short shaft 33 and does not cause the lifting weight oscillate right and left. Therefore, the present invention does not have to provide a set of two of lifting weights at both lateral sides of the positioning base 3.

The present invention has now been described in detail, but it will be understood that variations and modifications can be effected within the spirit and scope of the invention.

I claim:

1. An apparatus for automatically but delayedly lifting a toilet seat, comprising:

a positioning base having two elongated through slots for passing through by respective bolts that secure said positioning base on a toilet and a shaft laterally extending from a sidewall of said base;

a lifting weight including a fore portion having an aperture for receiving said shaft for pivotally supporting said lifting weight on said shaft, said weight including a mid-portion having a front chamber and a post-portion having an upper chamber and a lower chamber, said front chamber being in direct fluid communication with said upper chamber so as to be substantially without restriction on flow of a fluid therebetween and said lower chamber having a first small aperture and a second small aperture which are respectively in fluid communication with said front chamber and said upper chamber with restriction on said flow of said fluid; and an L-shaped lifting rod having one end of the L-shape thereof secured on a front end of said fore-portion of said lifting weight and an opposite end of the L-shape thereof for insertion between a toilet and a toilet seat.

2. The apparatus in accordance with claim 1, wherein said lifting weight further includes an elongated positioning rack, longitudinally secured on said lifting weight and with a plurality of holes spaced apart from one another, a balance weight, and bolts for securing said balance weight on said rack at selected ones of said holes, whereby the balance condition of said lifting weight in association with said toilet seat is adjusted in use by said selection of said ones of said holes.

3. The apparatus in accordance with claim 1, wherein said lifting weight further includes an opening at an upper surface of said lifting weight for supplying said fluid into one of said chambers, and a cap for attachment on said opening to prevent said fluid from flowing out.

4. In an apparatus for automatically raising a toilet seat from a toilet bowl, comprising a lifting weight, a positioning base, and a lifting rod; said lifting weight being substantially a hollow housing for containing operative water and including a fore-portion, a mid-portion and a post-portion; said mid-portion is formed as a front chamber; said post-portion is formed with an upper chamber and a lower chamber; said front chamber is in fluid communication with said upper chamber; said lower chamber includes a first small aperture and a second small aperture which are respectively in fluid communication with said front chamber and said upper chamber; and the improvements comprising:

said fore-portion of said lifting weight is formed with a transverse through shaft hole;

said positioning base including two elongated through holes adapted to be passed by two bolts for securing said positioning base on the toilet bowl, and a short shaft transversely extending from one lateral sidewall of said positioning base; and short shaft can be received within said through shaft hole of the fore-portion of the lifting weight for pivotally mounting said lifting weight to said positioning base; and said lifting rod including two ends, wherein one end thereof is secured on said fore-portion of said lifting weight, and the other end thereof is adapted to inserted between the toilet seat and the bowl.

* * * * *